United States Patent [19]

Müller

[11] 4,154,003

[45] May 15, 1979

[54] COMBINED DRUM WASHER AND DRYING ARRANGEMENT

[75] Inventor: Franz Müller, Bad Honnef, Fed. Rep. of Germany

[73] Assignee: August Lepper, Maschinen-und Apparatebau GmbH, Bad Honnef, Fed. Rep. of Germany

[21] Appl. No.: 697,739

[22] Filed: Jun. 18, 1976

[30] Foreign Application Priority Data

Jul. 2, 1975 [DE] Fed. Rep. of Germany ..... 2529577

[51] Int. Cl.[2] ..... F26B 21/08

[52] U.S. Cl. ..... 34/32; 34/77; 68/18 C; 68/20; 34/75

[58] Field of Search ..... 68/20, 18 C; 34/73, 34/75, 77, 133, 32

[56] References Cited

U.S. PATENT DOCUMENTS

| | | | |
|---|---|---|---|
| 2,717,456 | 9/1955 | Smith | 34/75 |
| 2,720,037 | 10/1955 | Erickson | 34/75 |
| 2,743,533 | 5/1956 | Smith | 34/75 |
| 2,833,056 | 5/1958 | Smith | 34/75 |
| 2,856,699 | 10/1958 | Frey | 34/75 |
| 3,022,581 | 2/1962 | Smith | 34/75 |
| 3,132,005 | 5/1964 | McMillan | 34/75 |
| 3,266,166 | 8/1966 | Fuhring | 34/75 |
| 3,805,404 | 4/1974 | Gould | 34/75 |
| 3,816,070 | 6/1974 | Candor et al. | 34/133 |

*Primary Examiner*—John J. Camby
*Assistant Examiner*—Larry I. Schwartz
*Attorney, Agent, or Firm*—Cushman, Darby & Cushman

[57] ABSTRACT

An improved combination washer-dryer comprised of an inner and outer container which are spaced apart so as to form a condensation chamber therebetween. A cooling medium and moist air withdrawn from the inner drying container are simultaneously forced through that chamber which cools the air and causes moisture contained therein to be condensed and thus separatable from the air. Additional condensation and water separators can be employed to further treat the circulating air prior to that air being reheated and returned to the inner drying container.

17 Claims, 5 Drawing Figures

COMBINED DRUM WASHER AND DRYING ARRANGEMENT

This invention relates to a combined drum washer and dryer with air circulation in a closed circle, in which the moisture-laden air can be circulated via the washing drum, by way of a condenser, charged with water from the outside, a ventilator and a radiator for heating of the dry air.

Combined drum washers and dryers have been known in the prior art. U.S. Pat. No. 3,387,385 shows an arrangement where moisture-laden air is drawn off from an inside drum and cooled by the addition of cold water so as to condense water vapor. The separated, dryer air is again returned by way of a suction-pressure blower into the liquor tank, whereby it is heated upon introduction into the liquor tank with the help of a radiator.

In this known drying arrangement, the moisture-laden air is drawn off over a relatively small surface area of the inside drum so that the volume of air circulated per unit of time is relatively small. One major disadvantage of such prior art combined washing and drying arrangements is that the period of time required for drying is very great and usually is in excess of 2 hours for a standard wash load. This disadvantage results, on the one hand, as the result of the circulation path for the recirculated air and, on the other hand, as a result of the relatively low degree of effectiveness of the condensation arrangement.

Another known combined drum washer and dryer arrangement is shown in Swiss Pat. No. 280,805. In this arrangement the moisture-laden air drawn off in the central area of the drying drum is directed into a rear channel so it can be recirculated. Located in that rear channel is a plate condenser through which cooling water is pumped. The air being recirculated has less moisture as a result of its contact with the condensation apparatus and thereafter the circulating air is guided across heating surfaces and heated thereby. The heated air is then reintroduced into the drum, with the help of a suction-pressure blower via a perforated part along the outside periphery of the rear wall of the inside drum, whereby the air is again charged with moisture and the circulation cycle starts all over again.

The feeding in of the heated air through either the outside perforation or else the rim perforation on the rear side of the drum is very unfavorable, especially during the initial drying process since the relatively wet wash is packed relatively thickly on the outside edge of the drum and the fed-in, as well as warmed-up recirculated air, cannot be charged optimally with moisture. During the drying process the laundry is initially cooled and as a consequence the temperature of the recirculated air is kept at a relatively low level during the main part of the drying time. Thus, because of the disadvantages of this particular device the effective drying time needed for one load of laundry is also disproportionately long.

The feeding of recirculated air by way of a radiator located in a bulge in the outside container, whereby recirculated air is introduced by way of perforations on the inside drum and corresponding perforated ribs projecting into the inside drum for a better intermixing with the laundry has also been known. U.S. Pat. No. 2,314,748 describes a device suitable only for drying which likewise operates with recirculated air but wherein a portion of the moisture-laden air is discharged to the outside and is replaced by fresh and it is hoped somewhat dryer ambient air. While the perforated ribs on the inside drum improve the intermixing of heated air and wet laundry, the recirculation path is not closed and the fresh air may not be very much dryer than air remaining in the circulation path especially if the intake is near the machine.

In order to improve the intermixing of the recirculated air with wet laundry, it is also known to conduct air over a heater positioned above the liquor container through a suitable opening provided therein. As a result, the heated recirculated air is directed toward the laundry from the inside of the inner container or drum whereby enhancing the intermixing with the wet wash and also improving the amount of moisture picked up in the air emerging via the perforations in the outside surface of the inner container or drum.

Further, U.S. Pat. No. 2,718,711 discloses a dryer in which fresh air is fed from the outside via a radiator, which is disposed in a relatively large surfaced bulge in the outside drum and is provided with a radiation plate which reflects the produced heat radiation in the direction of the inside container or drum.

The disadvantages of known combined drum washers and dryers primarily relate to very poor evaporation performance in the order of magnitude of about 8 to 10 $cm^3$/minute so that consequently very long drying times result, whereby normal drying times are about 150 minutes per 2.5 kg of laundry. Of course, this relatively poor drying performance consumes great amounts of energy and cooling water. In the case of dryers-only which do not operate with recirculated air, but which discharge the moisture-laden air into the atmosphere, more favorable drying times can indeed be achieved with a considerable expenditure of energy. However, because of their construction such dryers cannot be combined with drum washers and still maintain their drying performance, as the environmental influence through heat and moisture in the flow of used air would be undesirable.

The present invention has as its primary object the creating of a combined drum washer and drying arrangement, in which the operating time for drying can be considerably decreased to that of a drying-only arrangement and wherein the comsumption of cooling water and power consumed during drying can be decreased considerably by utilization of the heat from the process. Thus, through use of the present invention the finishing costs must only be slightly influenced by the insertion of the drying arrangement. Another object of the present invention is to reduce the drying time to about 70%, the comsumption of cooling water to about 75% and the power consumption for the heating to about 10% vis-a-vis hitherto known combined drum washer and drying arrangements for normal laundry loads related to about 2 kg of dry laundry.

Starting out from the initially mentioned combined drum washer and drying arrangement, these and other objectives are achieved, according to the invention, by a combination of the following individual measures:

(a) The circulating air can be drawn off preferably in the lower area of the rear side of the liquor container;

(b) The cooling water can be fed in at about half the height, preferably on both sides of the liquor tank, in such a way that a film of water develops on the inside of the liquor tank as a result of the circulating air, guided downwards during drawing-off, and that moisture is separated from the circulating air by condensation;

(c) a radiator with a radiation plate pointed to the drum is disposed in the upper part of the liquor tank, distributed over a sector, with which radiation plate the inside drum is heated directly by radiation;

(d) the air, cooled by condensation, is again blown into the drum by means of a suction-pressure blower system from above, whereby the circulating air is guided via the radiation plate for the purpose of heating.

A combined drum washer and drying arrangement designed according to these characteristics produces a considerable reduction in the time required for drying. This is the result of the favorable combination of direct heating of the inside drum by way of the outside surface of the drum cylinder, whereby the wash and the atmosphere surrounding it can be maintained at a temperature in which the fed-in circulating air is charged with moisture to full saturation. Also the forced circulation produced between the inner and the liquor along with the preferred drawing-off of the withdrawn air from the lower area of the liquor tank helps to assure that the cooling water supplied for condensation purposes will flow as a substantially continuous film of water on a large surfaced part of the inside of the liquor tank. Thus, the circulating air withdrawn from the inside drum over or across that substantially continuous film of cooling water will be cooled and a considerable portion of the moisture contained therein will be condensed and separated from the air and thus able to be drained away with the cooling water. At the same time, the majority of slubs or lint particles entrained in the air withdrawn from the inside drum, are seized or collected by the film of water and discharged by way of the draining system, so that they are kept away from the suction-pressure blower system and from the heater. The circulation air is reintroduced over a large surface via the outside of the heater, and in particular, heat will be radiated into the inside drum, so that the temperature therein will be raised to a temperature which is most appropriate for allowing the air therein to absorb moisture.

In order to shorten the drying process still further, provision has been made for employing an additional condensation and water separation arrangement over which the circulating air is conducted after being drawn off from the liquor tank. This arrangement is particularly effective whenever the circulation air carried away from the liquor tank is used first in a heat exchanger for heating the circulating air. In this heat exchanger, a set of interior and exterior tubing are preferably arranged coaxially, at least in stretches, whereby the inside line conducts the circulating air from the liquor tank to the additional condensation and water separation arrangement and the outside line conducts the circulating air from the condensation and water separation arrangement to the inner drum or drying container.

With the help of this design, it will be possible to reduce drying time since heat obtained during processing in the heat exchanger aids in heating the circulating air being returned into the inside drum. By utilizing heat generated during the drying process that drying process is made more economical.

A further development of the invention provides, furthermore, that the conduction of the air across the radiation plate be developed such that the circulating air be conducted in a flat channel extending essentially across the entire radiation of heating plate. In order to avoid any loss of processing heat, provision has been made, furthermore, for employing a suitable layer of insulation on the exposed portions of the channel.

In order to reduce the drying time still further, an additional heater can be employed in the circulating air conduit downstream from the suction-pressure blower and before the primary heater. Thus, circulating air guided across the primary heating plate will have been preheated so that less energy is needed to heat the air to the desired predetermined temperature so that heating the inside drum by direct radiation will be ensured.

Provision has been made preferably in a special development for the heat exchangers, made in stretches as coaxial conduits, to consist of a rigid inside pipe with the line lying outside being comprised of a hose which has been slipped onto the rigid inside pipe.

It will also be of advantage to arrange the heater in a pressed-out portion in the upper part of the liquor tank, whereby the pressed-out surface will constitute the radiation or heating plate. As a result of such construction, the production costs for the combined drum washer and dryer can be reduced to the point where the combined arrangement can be produced with a very small additional cost as compared to the drum type washing-only machines.

Other advantages and characteristics of the preferred embodiments of the present invention will also result from the following description taken together with the drawings in which.

Figure 1:
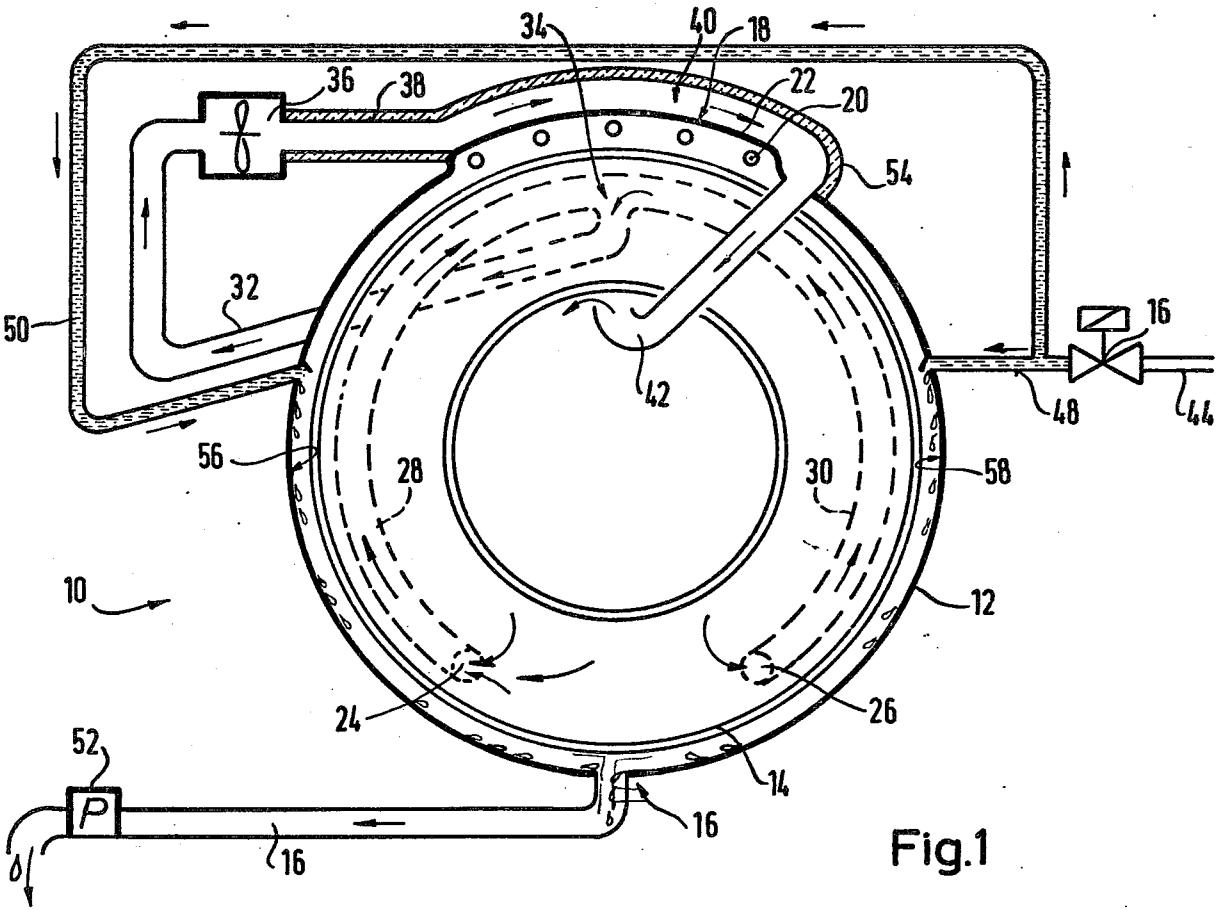
FIG. 1 is a schematic cross-sectional presentation of a drum washer and drying arrangement with a closed circulating air system for the drying process, whereby moisture is effectively removed from the moist air withdrawn from the inner drum and lost heat from the heater is used for heating the circulating air.

According to FIG. 1, the drum washer and drying arrangement generally referred to at 10 comprises a drum shaped liquor tank 12, in which a perforated inside drum 14 is rotatably mounted so as to be disposed coaxially or eccentrically within and spaced away from liquor tank 12 so as to serve as a washing drum. On the underside of the liquor tank 12 is a draining system 16, by way of which the washing liquor during the washing process and the condensate, as well as the cooling water, can be discharged. The liquor tank 12, on its top side, has been provided with a bulge 18, in which a radiator 20 is installed, whereby the pressed-out surface of the liquor tank 12 serves as a radiation plate 22. Additionally, heat radiated in the direction of the inside drum is increased by radiation plate 22. The sheet metal of the inside drum 14 transmits the absorbed heat energy and delivers it to the laundry in drum 14. On the rear side of the liquor tank 12, apertures 24 and 26 are provided and run off pipes 28 and 30 are connected thereto by any suitable means such as welding or threaded connections (not shown). Pipes 28 and 30 are each suitably connected to a conduit 32 preferably in an upper area 34 of the liquor tank 12. Conduit 32 acts as a circulation air conduit and is suitably connected to the suction-pressure blower 36. The circulation path following suction-pressure blower 36 is comprised of air circulation conduit 38 which extends between blower 36 and one side of an air channel 40, constructed with a relatively large surface area extending around radiation or heating plate 22. Thus, the circulation path drying air follows will be from within inside drum 14 out through the perforations within the inside drum 14 to the space defined between liquor tank 12 and inside drum 14, where it is in contact with the film of cooling water formed on the inside surface of liquor tank 12. Thereafter, the air flows out of that space through apertures 24 and 26 in the rear wall of liquor tank 12, through conduit 32 and blower 36. The blower 36 then forces the air through air channel 40 past the heating plate 22 and thence through distributor pipe 42 back to the interior of inside drum 14.

As a result of that path, the lost heat yielded by the radiation plate 22 can be utilized for heating the dry air being returned to drum 14. The air channel 40 is constructed with as large a surface as possible with a relatively low height across the entire bulge 18 of the liquor tank 12 so that as much heating as is possible will occur. The circulating air is again introduced into the inside drum 14 from the air channel 40 via a distributor pipe 42 connected between the opposite side of the air channel 40 and the inside of inside drum 14 as shown in FIG. 1. The circulation air flowing through the air channel 40 absorbs the portion of the processing heat of the radiator 20 which would otherwise be lost, as a result of which the circulating air becomes more capable of absorbing steam.

Cooling water is continuously fed on both sides of liquor tank 12 by way of cooling water system comprised of a main cold water supply conduit 44, control valve 46 and separate supply lines 48 and 50 connected, respectively, to opposite sides of liquor tank 12. The cooling water is distributed so as to be finely dispersed on the inside surface of liquor tank 12 and supply lines 48 and 50 are each connected to liquor tank 12 preferably at about midway between the top and bottom of liquor tank 12 or slightly above that midway point as is best shown in FIG. 1. Since the cooling water is distributed in a finely dispersed manner and is a continuous fashion the inside walls of liquor tank 12 are wetted substantially evenly by the cooling water in an essentially continuous film of water. Furthermore, the forced conduction of the air to the apertures 24 and 26 aids in forming that film and causes the majority of slubs or accummulations of lint which may be carried along in the stream of circulating air exiting through the perforations in the walls of inside drum 14, to be seized or collected by the film of cooling water. Thus, the slubs and lint will be washed away toward the drainage system 16, so that they are pumped away together with the cooling water by pump 52.

In order to prevent any heat in the area of the radiator 20 and of the air channel 40 to be lost, the outside of the air channel 40 is coated preferably with a heat insulating layer 54.

The constructional design of the drum washer and drying arrangement, according to FIG. 1, has the advantage on the one hand, that the directly heated inside drum can transmit the stored heat directly to the wet laundry laying against the wall of the inside drum 14. When laundry drops down in the rotating inside drum 14, the heated laundry is mixed well with the warm circulating air fed in through distributor pipe 42, so that the circulating air being resupplied to the drum 14 can be recharged with water vapor up to the saturation point. The water vapor (steam) escapes through the holes or perforations in the inside jacket of the inside drum 14 primarily the perforations in the upper portion of drum 14 so that by drawing-off circulating air in the lower area of the rear side of the liquor tank 12, air circulation is forced past condensation surfaces 56 and 58 thereby obtaining a maximum cooling and so as to produce a maximum amount of condensation.

With such a structure for a combined drum washer and drying arrangement, the time required for drying laundry can be shortened considerably whereby drying times can be achieved which are similar to drying times for dryers-only.

Figure 2:
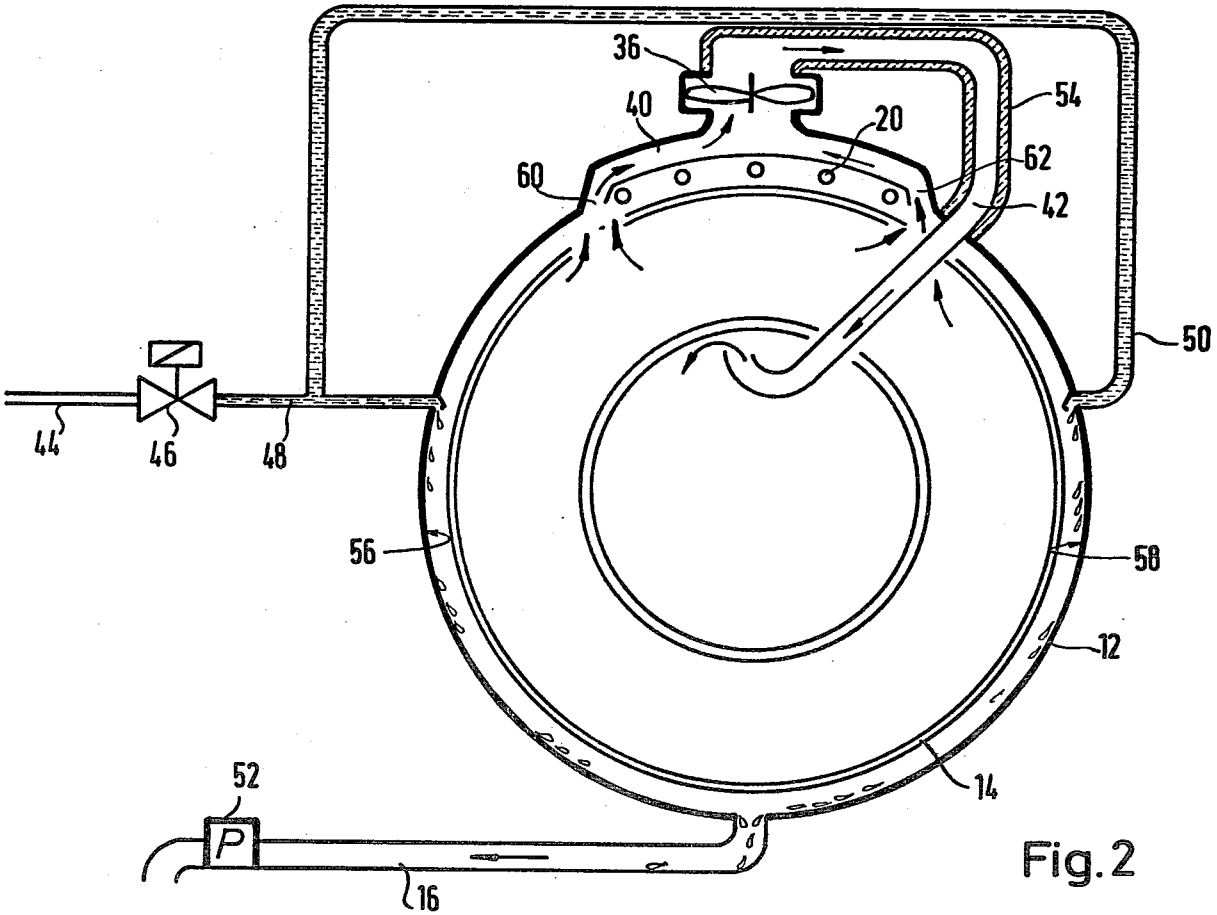
FIG. 2 is a schematic cross-section of a further development of the circulating air system for a drum washer and drying arrangement according to FIG. 1.

FIG. 2 shows a second embodiment of the combined drum washer and dryer, with which improved results can also be achieved. This second embodiment differs in that air circulation created by the rotation of the inside drum 14 which forces air through the perforated wall thereof, is guided past the condensation surfaces 56 and 58 and is drawn off on both sides of the radiation plate through suction apertures 60 and 62 and thereafter through air channel 40 and radiation or heating plate 22. Subsequent to yielding moisture through condensation while flowing past the condensation surfaces 56 and 58, the circulating air is heated and returned to inside drum 14 due to the action of suction-pressure blower 36.

Figure 3:
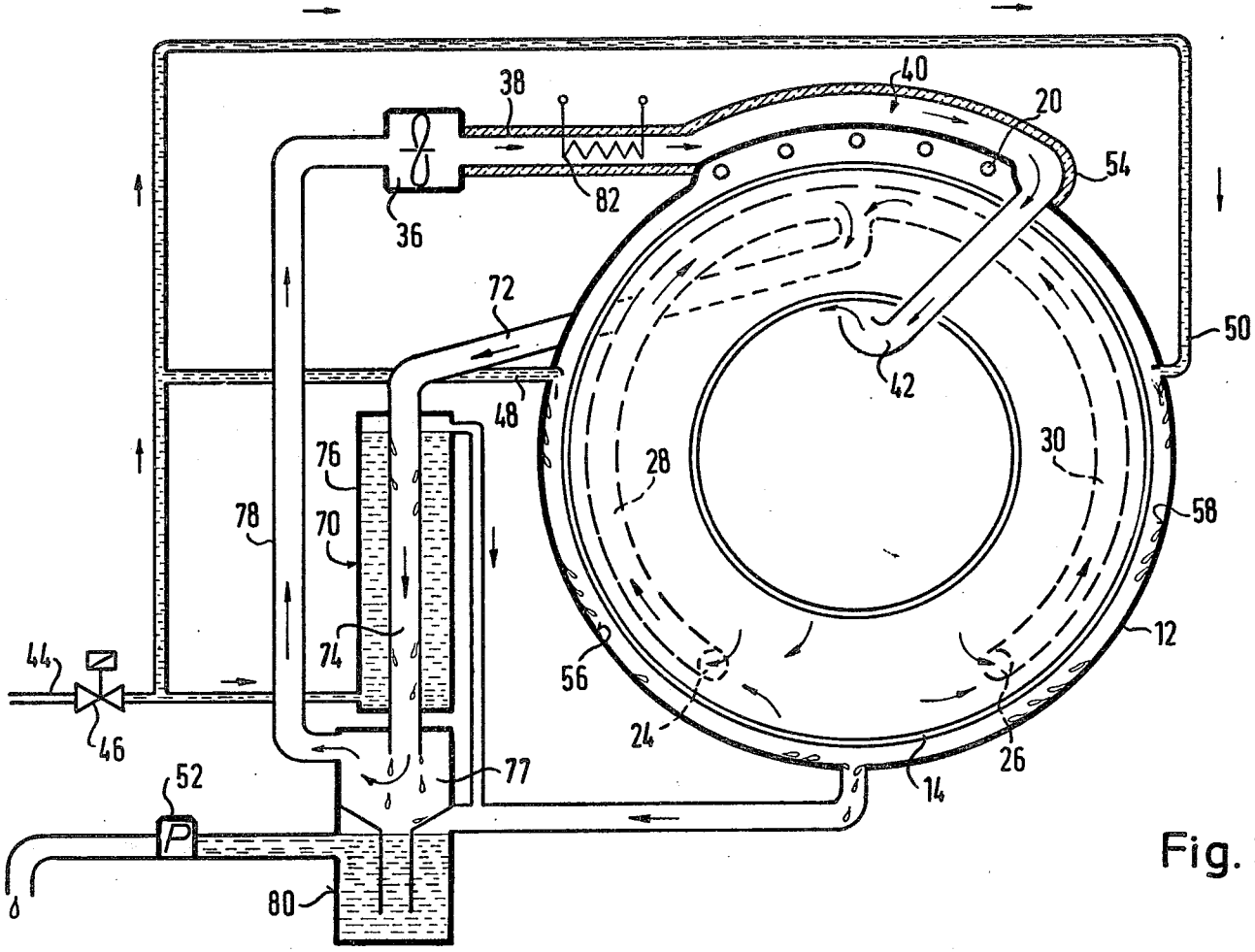
FIG. 3 is a schematic cross-section of another modified embodiment of the drum washer and drying arrangement as shown in FIG. 1 with a circulation air system which is guided via an additional condensation and water separation arrangement.

FIG. 3 shows another embodiment of the present invention wherein the liquor tank 12 is constructed in a similar fashion to that shown in FIG. 1. Apertures 24 and 26 continue to be disposed in the lower area of the rear wall of liquor tank 12 for drawing-off of circulating air at that low area and likewise the radiation or heating process in which heater 20 heats up the moist laundry. In addition, the cool water supply and the condensation process together with the discharge of the cooling and condensation water from liquor tank 12 is the same as described in FIG. 1. Further, the passage of the circulating air through air channel 40 by way of the radiator 20 and distributor pipe 42 back into the interior of the inside drum 14 is also as was described with regard to the embodiment shown in FIG. 1.

In the closed circulating-air circuit, however, another condensation and water separation arrangement, generally indicated at 70, has been inserted. Run off pipes 28 and 30 are shown as being connected to a conduit 72 which is connected between the liquor tank 12 and the suction-pressure blower 36 with the added condensation and water separation arrangement 70 being positioned therein. The condensation arrangement 70 consists of coaxial pipe lines 74 and 76 whereby the circulating air is conducted through the inside pipe 74 and the cooling water is conducted in counter current through the outside pipe 76. The inside pipe 74, which is an extension of conduit 72, terminates at a water separation arrangement indicated at 77 from which the circulating air is drawn off laterally through conduit 78 by suction-pressure blower 36 so that the condensate precipitating in the inside pipeline can drip down and be discharged by way of a siphon 80 and be pumped away by pump 52. As a result of this additional condensation and separation of water, the temperature of the circulating air can be further cooled so that an additional amount of moisture can be removed from the air by way of further condensation. This contributes quite considerably to the shortening of the drying time since the relatively dryer air can absorb additional amounts of moisture. Experiments show that such drying times can be reduced up to 70% as compared to the otherwise required drying time in case of combined drum washer and drying arrangements. Despite provision of an additional condensation arrangement as at 70, the consumption of cool water can also be considerably decreased. With the present invention heat energy which cannot usually be fed to the laundry and would otherwise be lost is used to heat the circulating drying air, prior to the return of that air to inside drum 14. Through this approach, the heating performance is improved about 20% over the usual drying time for dryers-only.

A further shortening of the drying period could be achieved by positioning an additional heating element 82 within air circulation conduit 38 as indicated in FIG. 3.

Figure 4:
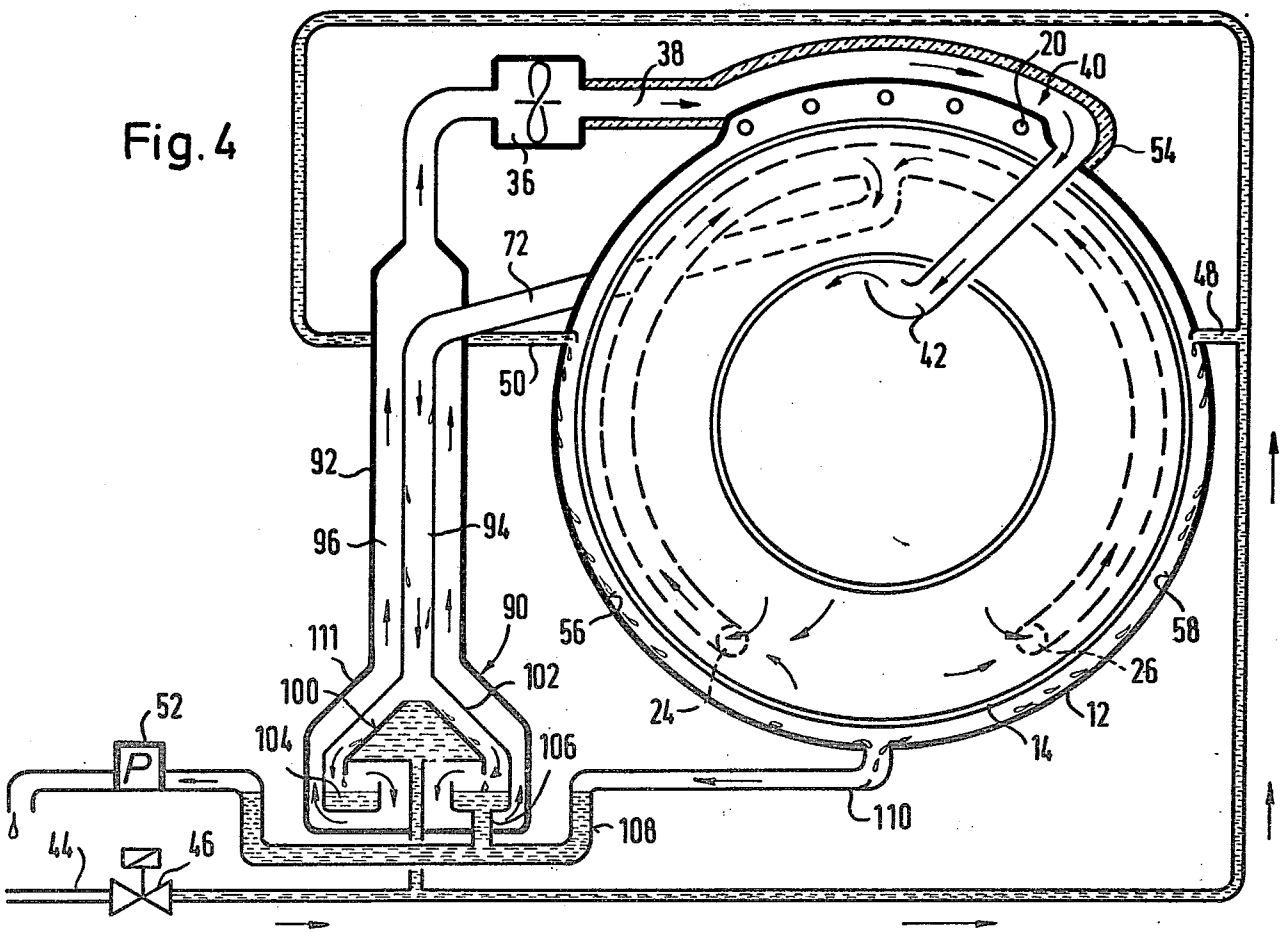
FIG. 4 is a schematic cross-section of still a further development of the drum washer and drying arrangement shown in FIG. 1 with an additional condensation and water separation arrangement as well as with a heat exchanger for further utilization of processing heat.

FIG. 4 shows still another embodiment of the drum washer and drying arrangement according to the present invention. A modified condensation and water separation arrangement is conbined with a heat exchanger 92 and is generally indicated at 90. Heat exchanger 92 preferably consists of coaxially guided pipes 94 and 96 whereby the inside pipe 94 conducts the circulating air coming from the liquor tank and the outside pipe 96 conducts the circulating air discharged to the suction-pressure blower 36. It has been found that the temperature of the air leaving liquor tank 12, through conduit 72 is about 100° C., whereas circulating air is cooled to about 80° C. and less upon leaving the condensation arrangement 90. Thus circulating air conducted through outside pipe 96 to suction-pressure blower 36 has already been preheated in the heat exchanger 92 thereby effectively utilizing the processing heat of air exiting from liquor tank 12. This preheated air is heated up further in the air channel 40 as a rule to about 120° C., prior to being returned to the inside drum 14.

The further condensation and water separation arrangement 90 of the embodiment shown in FIG. 4 is comprised of a pyramid-like inside condensing unit 100, through which cooling water flows, and a pyramid-like outer structure 102 which surrounds and is spaced a slight distance from the pyramid-like structure 100. The circulating air fed from inside pipe 94 of the heat exchanger 92 flows in the space defined by structures 100 and 102 where it is cooled so that condensed water is formed on inside condensing unit 100. The outer structure 102 is provided with a collecting cup 104 along its lower edge and collecting cup 104 is positioned so as to extend inwardly beneath inside condensing unit 100. Thus, when the condensed water formed on the surface of inside condensing unit 100 flows down that pyramid-like surface it will be collected by cup 104. A drain line 106 connects collecting cup 104 with a siphon 108 positioned in the drain line 110 exiting drum liquor tank 12. Thus condensate collected in collecting cup 104 and the siphon 108 positioned in drain line 110 can be discharged together with the condensate from the liquor tank 12 by pump 52. The circulating air is fed in by way of inside line 94 and conducted like a labyrinth around collecting cup 104 and between outside structure 102 and an outer housing 111 to the outside pipe 96 of the heat exchanger 92.

The embodiment shown in FIG. 4 is particularly effective since a great difference in temperature can be produced by additional intensive condensation. However, the creation of this large temperature difference does not require any additional heating devices since the additional waste heat from the withdrawn air is used in the heat exchanger 92 to preheat air circulated through heat exchanger 92 toward blower 36.

Figure 5:
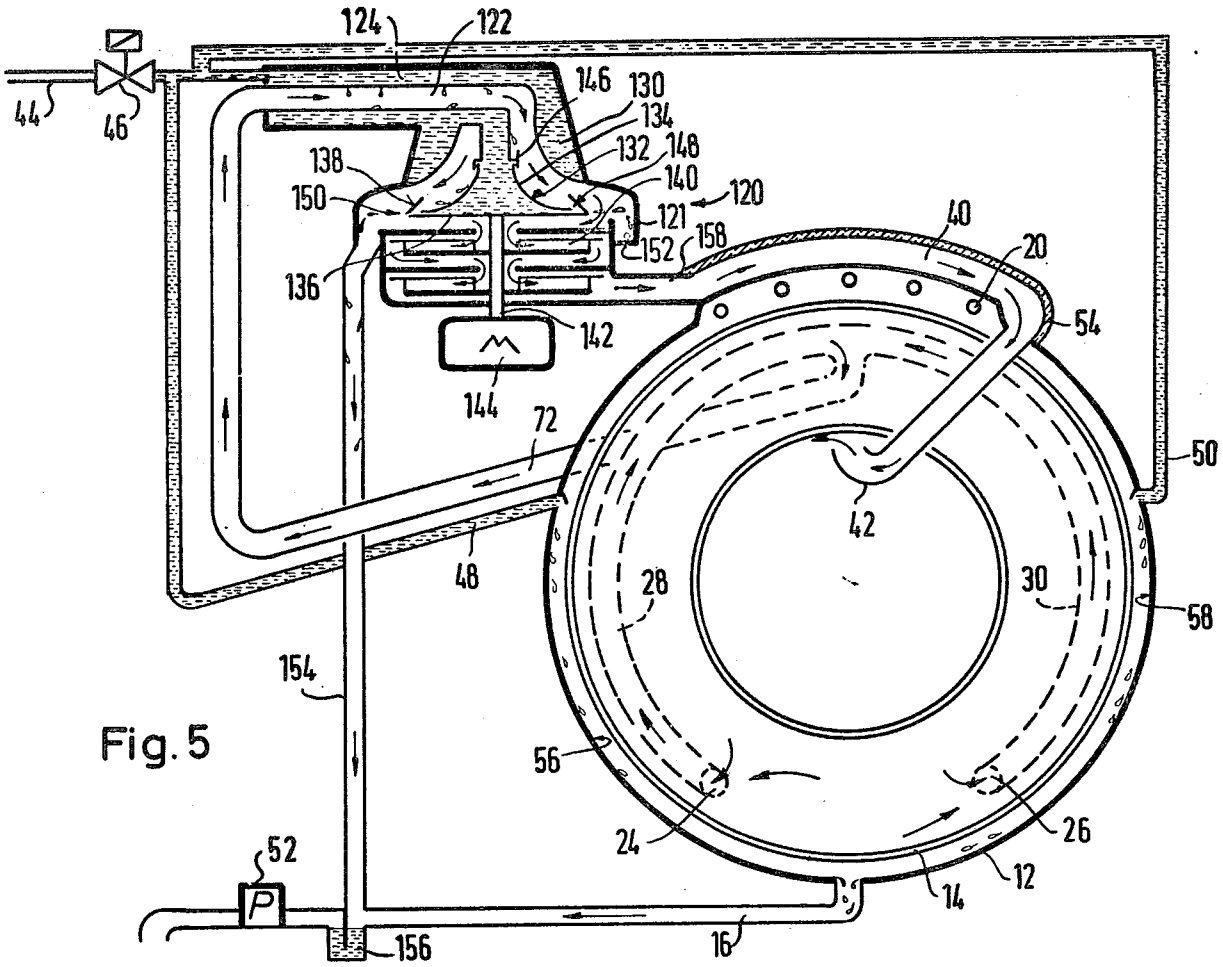
FIG. 5 is a schematic presentation of another modified embodiment of the drum washer and drying arrangement shown in FIG. 1 with an additional condensation and water separation arrangement in the closed air circulation system.

This is true also for another embodiment of the present invention as shown in FIG. 5. In this embodiment the condensation and water separation arrangement is further modified and is indicated generally at 120. The course of the cooling water to the liquor tank 12 acting as condenser and the radiation process for heating of the laundry, as well as the heating of the supplied air in the air channel 40 above the radiator 20 and the drawing-off of the circulating air from the liquor tank 12, take place in the same manner as described on the basis of FIG. 1. The suction line 72 leading away from the liquor tank 12 is fed to a modified condensation arrangement 120, which is comprised of an outer housing 121 and a coaxial system of pipes through which cooling water flows in the outside pipe 124 and which carries the circulating air in the inside pipe 122. The condensation arrangement 120 passes over directly into a water separator 130 which comprises a rotatable centrifugal disc 132 through which cooling water flows. The centrifugal disc 132 is a hollow body having an outer jacket 134 expanding in the shape of an inverted funnel, with its largest diameter associated with bottom disc 136. The peripheral edge of bottom disc 136 is turned upward around the lower periphery of outer jacket 134 so that a groove 138 is developed in which the condensate flowing in from the further condensation arrangement 120 and the condensate separating automatically on the centrifugal disc 132 can collect. The centrifugal disc 132 is connected coaxially with condenser 140 on drive shaft 142 of motor 144. The cooling water inlet to the inside cooled centrifugal disc 132 takes place by way of a rotationally movable gasket 146 positioned between the outside pipe 124 of condenser 120 and the centrifugal disc 132. The cooling water penetrating the centrifugal disc 132 flows out through small apertures 148 between the lower edge of the outer jacket 134 and the bottom disc 136 and is collected together with the condensate in groove 138. The groove 138 has apertures or bores 150 and while in particular one or two diametrically opposite bores are preferred, other arrangements should also be considered as being contemplated. Water collected in groove 138 emerges through bores 150 in the form of jets because of the high rpm of the centrifugal disc 132, and strikes the opposite wall of outer housing 121 surrounding the centrifugal disc 132. A collection channel 152 is formed within the bottom portion of outer housing 121 and in turn is connected to the drain system 16 by a drain line 154 and a siphon 156. Preferably, the wall of housing 121 is developed such that the emerging water deviating from the illustration strikes the housing wall at an obtuse or flat angle and is deflected downward and atomization of the water in this area should be avoided.

The circulation air is guided from the inner pipe 122 around the centrifugal disc 132 and is aspirated in the middle area of the bottom disc 136 by the condenser 140. Condenser 140 is a conventional multi-compartmented structure and conducts condensed circulation air via the air supply line 158 to the air channel 40 in which the circulating air is heated by waste heat from radiator 20.

Resistance of air circulation within the system is primarily overcome due to the presence of condenser 140 which acts as a suction-pressure blower, so that a perfect circulation of the air is assured.

The coaxial pipes 122 and 124 can be constructed in the form of a rigid inside line with a hose pushed over it as an outside line. Because of the air or water pressure, the hose serving as an outside line is filled up on all sides. On the basis of this development, it will be possible to accommodate the coaxial lines inside the housing of the drum washer and drying arrangement at a favorable place and also is a bent or curved form.

The use of the centrifugal disc 132 in the water separator has the advantage that the liquid precipitated by the condensation can be eliminated completely from the current of air, which contributes to the increase or effectiveness of the device. By employing the centrifugal disc 132, elimination of the condensed water from the stream of air is more readily assured since the drops of water are flung with sufficiently high pressure in the form of jets through the stream of air, so that the stream of air cannot entrain any water. Two apertures 150 in the groove 138 have proved to be best, and by placing the apertures opposite one another, balancing of the centrifugal disc becomes unnecessary. Since the flow of circulating air in the area of the centrifugal disc 132 is being expanded in cross-section, the circulating air becomes less turbulent and because of the low temperature, absorption of any new moisture is unlikely.

Thus, in drum washer and drying arrangement constructed according to the present invention described herein by elimination of more than 37 gr/minute in case of a washing machine of traditional size, the drying time and the cooling water consumption could be reduced by more than 75%, along with a reduction of more than 10% in the energy consumed during heating. Thus, advantageous results for a combined drum washer and drying arrangement equal to apparatus designed only for drying purposes can be achieved with the disclosed drum washer and drying arrangement which results could not be achieved heretofore.

It will now be clear that there is provided a device which accomplishes the objectives heretofore set forth. While the invention has been disclosed in preferred forms, it is to be understood that the specific embodiments described and illustrated herein are not to be considered in a limited sense as there may be other forms or modifications of the present invention which should also be construed to come within the scope of the appended claims.

What is claimed is:

1. A device for both washing and drying laundry comprising: outer container means for enclosing the washing and drying compartment; inner container means forming the washing and drying chamber and for holding the laundry being treated, said inner container being rotatably mounted within and spaced from said outer container means; air circulation means for forming an air circulation path within said device and for circulating air through that circulation path such that air is withdrawn from and subsequently returned to said inner container; heating means adjacent the air circulation path for heating air being circulated in the air circulation means and for directly heating the inner container, said heating means positioned so as to heat air prior to recirculation of the air back into said inner container means; cooling means for cooling air within said air circulation means, said cooling means positioned to cool air as the air is withdrawn from said inner container means; said cooling means includes a first condensation means located in the space defined between said inner and outer container means, cooling medium supply means for supplying a cooling medium to said first condensation means, said air circulation means includes means for directing air withdrawn from said inner container means through said first condensation means; and drain means for collecting and draining away the cooling medium and the condensation wherein said air circulation means includes blower means for withdrawing air from and returning air to said inner container means and wherein said cooling means includes second condensation means positioned in the air circulation path within said device and between said first condensation means and said blower means whereby the air withdrawn from said inner container means is also drawn through said second condensation means and cooled an additional amount thereby removing more moisture through additional condensation.

2. A combination washer-dryer device as in claim 1 wherein said first condensing means includes: inlet pipes attached to opposite sides of said outer container means at least midway between the top and bottom of said outer container means and control means for controlling the flow of a cooling medium through said inlet pipes so as to form a substantially continuous film on the interior surface of said outer container means; and wherein said air circulation means includes a plurality of perforations within said inner container means and at least one outlet in a lower portion of said outer container means so that air withdrawn from said perforations and said at least one outlet and thereby through said first condensation means and in contact with the cooling medium therein.

3. A combination washer-dryer as in claim 1 wherein said heater means is positioned downstream from said blower means so as to heat air emitted from said blower means.

4. A combination washer-dryer as in claim 1 wherein said second condensation means is comprised of an inner housing connected to said air circulation means so that air withdrawn from said first condensation means passes therethrough, an outer housing coaxially aligned with at least a portion of said inner housing means for connecting said outer housing to said cooling medium supply means and said drain means so that cooling medium will flow therethrough and water separation means for collecting and discharging water condensed out of the air flowing through said second condensation means.

5. A combination washer-dryer as in claim 4 wherein said water separation means comprises a collection cup which forms the bottom of said outer housing said collection cup extending beneath at least a portion of said inner housing such that the air will initially flow between the inner and outer housing and thereafter in a labyrinth-fashion between said collecting cup and said inner housing.

6. A combination washer-dryer as in claim 1 wherein said second condensation means comprises an inner housing, means for circulating a cooling medium through said inner housing, an outer housing positioned at least in part around said inner housing said outer housing forming part of the air circulation means so that the air flow is directed by said outer housing around said inner housing, means for collecting and discharging water condensed out of the air flowing through said second condensation means said collecting means being attached to said outer housing.

7. A combination washer-dryer as in claim 1 wherein said air circulation means further includes heat exchanger means positioned between said second condensation means and said blower means for preheating air exiting said second condensation with the air exiting said first condensation means.

8. A combination washer-dryer as in claim 7 wherein said heat exchanger includes inside and outside tube members, said tube members being coaxially aligned, said inside tube being rigid and said outside tube comprising a flexible hose fitted over said rigid inside tube member.

9. A combination washer-dryer as in claim 1 wherein a portion of the top of said outer container means comprises a pressed-out pocket, said heating means being positioned within said pressed-out pocket whereby the interior surface of said pressed-out pocket serves as a radiation plate.

10. A combination washer-dryer as in claim 9 wherein the exterior surface of said pressed-out pocket forms part of said air circulation means downstream from said blower means so that air passing thereover is heated.

11. A combination washer-dryer as in claim 1 wherein at least that portion of said air circulation means containing heated air is provided with an insulating covering.

12. A method for more efficiently drying laundry being treated in a combination washer-dryer having spaced apart inner and outer containers comprising the steps of: rotating the inner container; circulating moist air from the inner container through the space defined between the inner and outer containers and subsequently withdrawing that air from the lower area of the outer container; forming a first cooling zone in the space defined between the inner and outer containers by feeding a cooling medium therethrough in a continuous fashion so that air circulating therein is in direct contact with the cooling medium and forms the cooling medium into a substantially continuous film over a predetermined portion of the interior surface of the outer container; condensing at least a portion of the moisture in the moist air as the moist air circulates through the first cooling zone; collecting and draining away the cooling medium and the condensed moisture; returning the air withdrawn from the outer container to the inner container and simultaneously heating the air being returned to the inner container to a predetermined temperature and directly heating the inner container, including the additional step of feeding a cooling medium through a second cooling zone and passing the air withdrawn from the inner container through the second cooling zone so as to condense a further amount of moisture from the air withdrawn from the inner container.

13. A method as in claim 12 including the additional step of directing the air withdrawn from the first cooling zone through a first portion of heat exchanger and passing the circulating air withdrawn from the second cooling zone through a second portion of the heat exchanger.

14. A method as in claim 12 further including the steps of directing the air exiting the second cooling zone through a condensate collection area and draining the condensate from the collection area.

15. A method as in claim 12 wherein the predetermined portion of the interior surface of the outer container comprises at least half of that interior surface.

16. A device for both washing and drying laundry comprising: outer container means for enclosing the washing and drying compartment; inner container means forming the washing and drying chamber and for holding the laundry being treated, said inner container means having perforated sidewalls and being rotatably mounted within and spaced from said outer container means, air circulation means for forming an air circulation path within said device and for circulating air through that circulation path such that air is withdrawn from and subsequently returned to the interior of said inner container, heating means adjacent the air circulation path for heating air being circulated in the air circulation means and for directly heating the inner container, said heating means positioned so as to heat the circulating air prior to its return into said inner container means, cooling means for cooling air within said air circulation means, said cooling means positioned to cool air as the air is withdrawn from said inner container means through said perforations, said cooling means including first condensation means located in the space defined between said inner and outer container means, means for supplying cooling medium to said first condensation means, said air circulation means includes means for directing air withdrawn from said inner container means through said first condensation means said directing means defined by at least one aperture adjacent the bottom of said outer container, at least a first air return conduit connected to said at least one aperture and extending to the upper portion of said outer container and a second air return conduit connected to said first air return conduit and extending into the interior of said inner container means for returning the air back to said inner container means above the laundry, said second air return conduit including means for circulating air and a heating chamber adjacent said heating means in which the circulating air is heated and drain means for collecting and draining away the cooling medium and the condensation.

17. A combination washer-dryer for washing and drying laundry comprised of an outer enclosed tank, an inner perforated tank positioned within and spaced from said outer tank and arranged to rotate therein, at least a first condensation chamber defined by the spaced apart walls of said inner and outer tanks and extending along a major portion of the bottom half of the interior of said outer tank, means for supplying cooling medium to said first condensation chamber so that a film of said cooling medium is formed on said major portion of the interior wall of said outer tank, air heating means positioned so as to directly heat said inner tank, and a closed air circulation path comprised of the perforations in said inner tank and said first condensation chamber, means defining air removal apertures located in the lower portion of said outer tank and positioned such that water will not be sucked in with the air, air circulation means for circulating air through said air circulation path, first conduit means for connecting together said aperture means and said air circulating means, and second conduit means for directly connecting said air circulating means to the interior of said inner tank for returning air to the interior of said inner tank above the laundry held therein.

* * * * *